US005395664A

United States Patent [19]

Thompson, Jr.

[11] Patent Number: 5,395,664

[45] Date of Patent: Mar. 7, 1995

[54] CORROSION RESISTANT ARTIFICIAL FLOWER

[75] Inventor: James L. Thompson, Jr., Montgomery, Ala.

[73] Assignee: CCC Associates Company, Montgomery, Ala.

[21] Appl. No.: 839,470

[22] Filed: Feb. 21, 1992

[51] Int. Cl.[6] ..... A41G 1/00

[52] U.S. Cl. ..... 428/24; 156/61

[58] Field of Search ..... 156/61; 428/24, 25, 428/26, 23

[56] References Cited

U.S. PATENT DOCUMENTS

| | | | |
|---|---|---|---|
| 501,134 | 7/1893 | Francis | 47/55 |
| 1,644,482 | 10/1927 | Muller | 428/24 X |
| 1,730,628 | 10/1929 | Rogers | 428/26 |
| 1,748,636 | 2/1930 | Crockett | 428/26 |
| 1,831,560 | 11/1931 | Ham et al. | 428/26 |
| 1,858,148 | 5/1932 | Freese | 428/26 |
| 3,041,766 | 7/1962 | Decamp | 428/24 |
| 3,471,964 | 10/1969 | Cherry et al. | 428/24 X |
| 4,215,163 | 7/1980 | Lee | 428/24 |
| 4,293,997 | 10/1981 | Lee | 428/24 |
| 4,333,778 | 6/1982 | Griffin | 428/24 X |
| 4,708,892 | 11/1987 | Young et al. | 428/24 |
| 5,047,268 | 9/1991 | Cheng | 428/24 |

FOREIGN PATENT DOCUMENTS

| | | | |
|---|---|---|---|
| 1600027 | 10/1981 | United Kingdom | 428/26 |

*Primary Examiner*—Henry F. Epstein

*Attorney, Agent, or Firm*—Willian Brinks Hofer Gilson & Lione

[57] ABSTRACT

An artificial flower stem for use in water comprising a corrosion resistant metal stem with the metal stem having a thin coating of material simulating the look of a flower stem. In a second embodiment, the the artificial flower stem comprises a resilient tubing member forming a stem. The tubing member is hollow with a separate cap member inserted therein creating a waterproof connection.

6 Claims, 2 Drawing Sheets

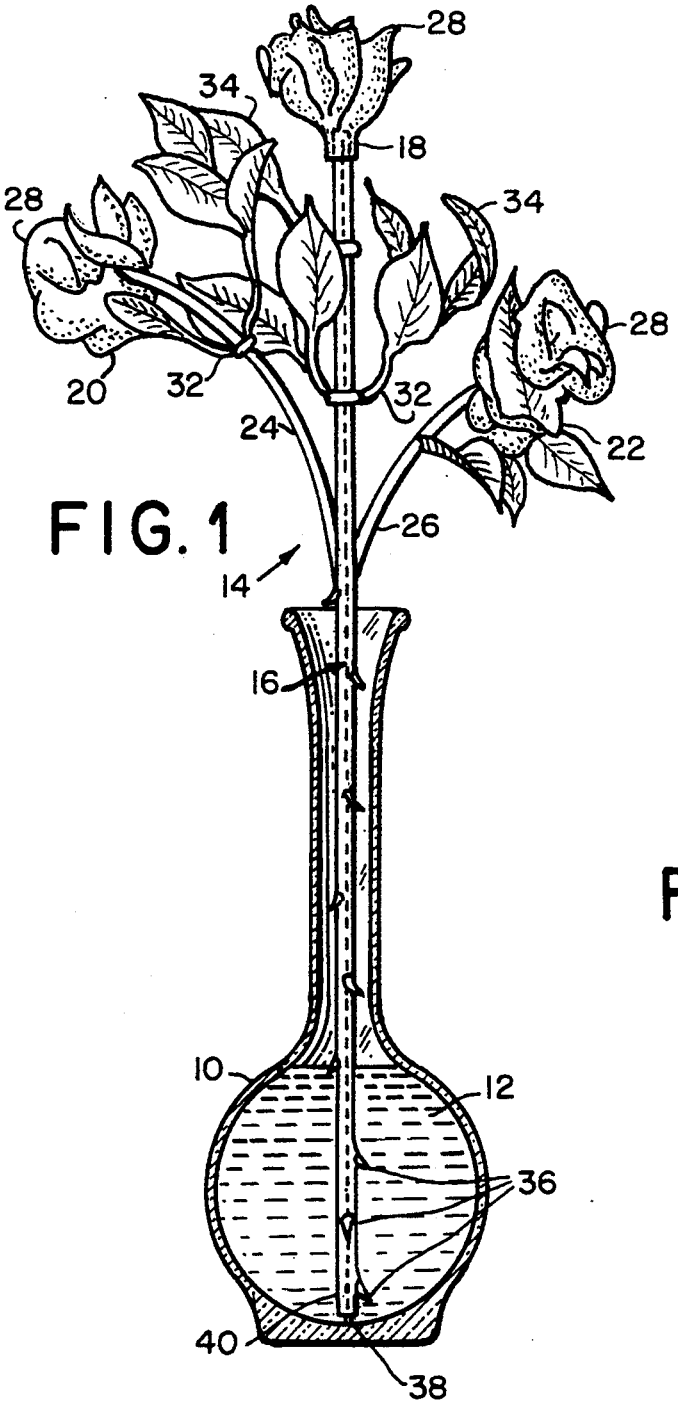
FIG. 1
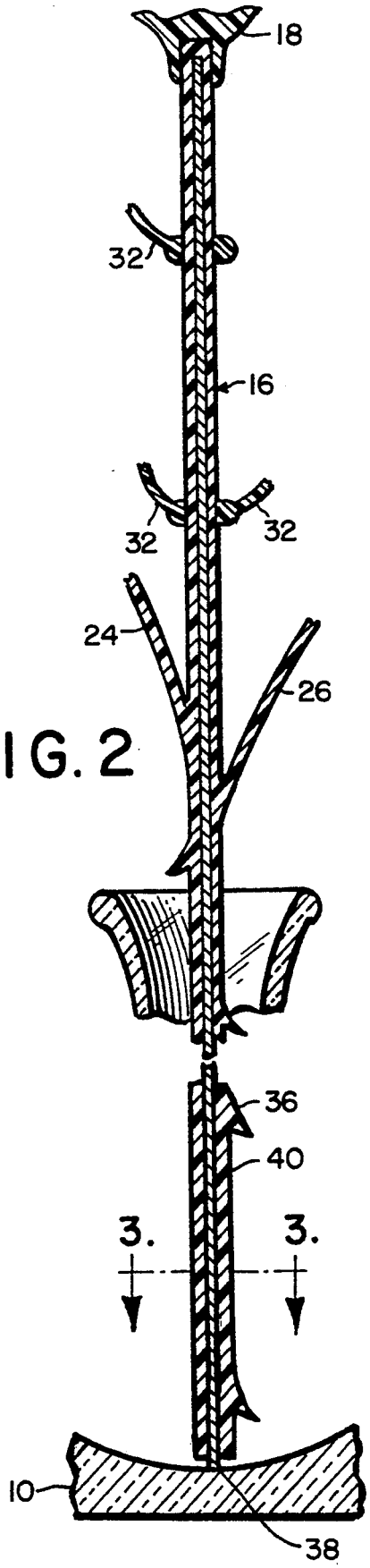
FIG. 2
FIG. 3
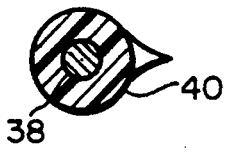

FIG. 4
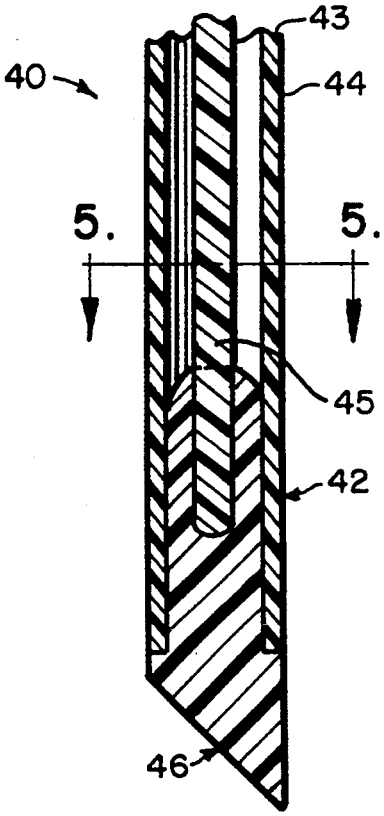
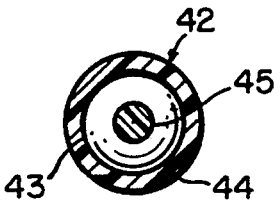
FIG. 5
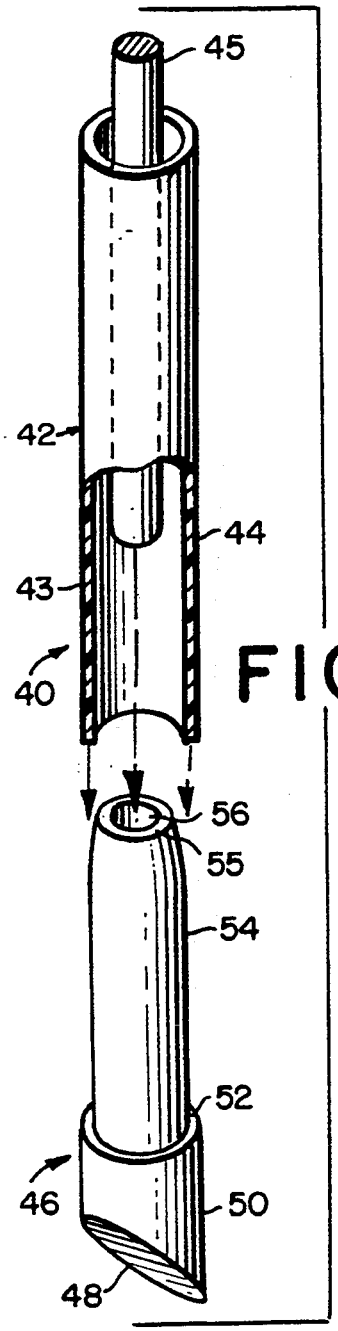
FIG. 6

CORROSION RESISTANT ARTIFICIAL FLOWER

TECHNICAL FIELD

This invention relates to materials and methods of presenting artificial flowers. More particularly, the invention relates to a water resistant artificial flower stem.

BACKGROUND OF THE INVENTION

It has long been known how to construct artificial flowers. A plastic stem may be integrally molded around a reinforcing wire to create the stem. Similarly, a tubular member may be created to fit over a reinforcing wire to produce a stem supporting the flower.

In use, artificial flower stems are routinely cut to adjust the length of the stem to a desired height. However, by cutting the stem of an artificial flower whether integrally molded with plastic or with a tubular stem, the reinforcing wire will become exposed.

Unfortunately, artificial flowers for decorative or personal use are deleteriously affected by water. As a result, if a cut artificial flower is placed into a vase with water, the reinforcing wire will become exposed to the water. Over time, the reinforcing wire will oxidize in the water creating the unsightly appearance of rust. One attempt to overcome the problems associated with rust is described in U.S. Pat. No. 1,858,148 to Freese wherein a wire is wrapped with waterproof tape. However, the tape may become undone exposing the stem to water. Furthermore, by cutting the stem of the '148 patent, the tape will still allow the base of the wire to be exposed to water thereby allowing rust to form.

Another attempt to overcome the problems associated with the oxidation of artificial flower stems is described in U.S. Pat. No. 1,831,560 to Ham. A wire stem is wrapped in a strip of crepe paper. The entire flower is dunked in varnish to provide a clear waterproof coating. However, if the stem is cut to adjust the height of the flower, the tip of the reinforcing wire will again be exposed to the water creating the opportunity for rust to form. Furthermore, the varnish on the stem will prevent the flower from being freely adjustable to allow for a desired angular presentation. More, should the stem be adjusted after the varnish has dried, the coating may crack allowing water to access the wire causing rust.

SUMMARY OF THE INVENTION

In order to achieve the objects of the invention and to overcome the problems of the prior art, the present invention may be embodied in various forms. In a first embodiment, an artificial flower for use in water comprises a corrosion resistant metal stem. The metal stem has a thin coating of material simulating the look of a flower stem. The metal stem is composed of a corrosion resistant material such as stainless steel, bronze or other material with similar properties. Thus, the metal stem can be exposed to water without the risk of rust forming.

In a second embodiment, the water-resistant artificial flower has a resilient tubing member forming the flower stem. The tubing member encloses a reinforcing metal wire stem. A water-resistant cap shaped to resemble the appearance of a cut flower, is inserted into the end of the tubing member. The cap and the tubing member are composed of a water-resistant material such as plastic or a material with similar properties. The use of the above-described embodiments allows for the artificial flower to be cut to a desired height and shaped to a desired angle, while retaining a water-resistant character to allow the flower to be placed in water without risk of oxidation.

BRIEF DESCRIPTIONS OF THE DRAWINGS

FIG. 1 illustrates a perspective view of a water-filled vase holding an artificial flower according to one embodiment of the present invention.

FIG. 2 illustrates a sectional view of the artificial flower embodiment of FIG. 1.

FIG. 3 illustrates a sectional view of the artificial flower embodiment of FIGS. 1 and 2 taken along the lines 3—3 of FIG. 2.

FIG. 4 illustrates a sectional view of another embodiment of the artificial flower stem of the present invention.

FIG. 5 illustrates an exploded view in partial cross-section of the artificial flower stem embodiment of FIG. 4.

FIG. 6 illustrates a sectional view of the artificial flower stem embodiment of FIG. 4 taken along the lines 6—6 of FIG. 4.

DETAILED DESCRIPTION OF PREFERRED EMBODIMENTS

The remaining portion of this specification will describe preferred embodiments of the invention when read in conjunction with the attached drawings, in which like reference characters identify identical apparatus.

FIG. 1 illustrates a perspective view of an artificial flower in accordance with the present invention. The flower represented in the following drawings is a rose, but it should be understood that the teachings outlined herein may be applied equally to other flowers and arrangements. A vase 10 filled with water 12, supports the artificial flower assembly 14 of the present invention. The flower assembly 14 comprises a stem 16 with an upper end having three simulated flower blooms 18, 20 and 22. Flower bloom 18 is attached to the stem 16. Flower blooms 20 and 22 extend from two side stems 24 and 26 and extends upwardly and outwardly from the stem 16. The flower blooms 18, 20 and 22 have a calyx (not shown) and a flower corolla 28. Each calyx has integral calyx sepals (not shown) extending therefrom. Each flower corolla 28 includes a plurality of simulated petals extending outward from the calyx. A plurality of petiole stems 32 each bearing simulated leaves 34 extend from the main stem 16 and the side stems 24 and 26.

The flower calyx and corolla 28 is supported by a main stem 16 having a plurality of integrally molded thorns 36. As best seen in FIGS. 2 and 3, the main stem 16 is composed of a reinforced metal wire core 38 around which is molded a unitary sheath 40 simulating the appearance of a flower stem. FIG. 3 shows the unitary nature of the sheath 40 and the wire core 38. The sheath 40 is made from any suitable material including plastics such as polyethylene, various rubber compounds or other materials with similar properties known to those of ordinary skill in the art. Furthermore, the sheath 40 is preferably green in color in order to create a realistic flower stem appearance.

The reinforced metal wire core 38 is preferably made from a corrosion resistant material such as stainless steel, bronze or other non-oxidizing materials. The use of a non-oxidizing material allows the artificial flower to be cut to a desired height. As can be seen in FIG. 1, the tip of the wire core 38 can be exposed to the water 12 in the vase 10 without risk of discoloring the water due to rust.

Another embodiment of this invention can be seen in FIGS. 4–6. An artificial flower stem 40 is composed of a hollow tubular member 42. The tubular member 42 has an inside wall 43 and an outside wall 44. The upper end of the tubular member 42 holds a calyx and flower corolla (not shown). A reinforcing wire 45 is freely located within the tubular member 42. The reinforcing wire 45 may be made from stainless steel, bronze, galvanized iron wire or other materials known to those of ordinary skill in the art. The wire 45 may have a sheath preferably made from plastic or the like.

A cap member 46 engages the lower end of the tubular member 42. The cap member 46 has a downwardly angled bottom surface 48. An outside wall 50 extends upward from the bottom surface 48. A rim 52 extends inward and perpendicular to the outside wall 50. An upper wall 54 extends upward from the rim 52. The upper wall 54 forms an elongated ring shape with a top surface 55. The upper wall 54 defines a cavity 56. The cavity 56 extends downward into the cap member 46. The tubular member 42 and the cap member 46 are made from any suitable material such as polyethylene, rubber or other materials with similar properties known to those of ordinary skill in the art. Furthermore, the tubular member 42 and the cap member 46 are preferably green in color in order to create a realistic flower stem appearance.

As shown in FIG. 5, the upper wall 54 of the cap member 46 matingly engages with the inside wall 43 of the tubular member 42. The upper wall 54 of the cap member 46 is sized to engage the inside wall 43 of the tubular member 42 so securely that a waterproof engagement occurs. However, the upper wall 54 is sized to allow users to readily remove the cap member 46 from engagement with the tubular member 42.

The above defined structure allows a user to readily cut an artificial flower to a desired height and place the flower in a water-filled vase. A user would grip the tubular member 42 and the outside wall 50 of the cap member 46 and pull downward on the cap member 46. When cap member 46 is free from engagement with the tubular member 42, the tubular member 42 could then be cut in order to achieve a desired height. The cap member 46 would then be reinserted into the tubular member 42 as shown in FIG. 4. Accordingly, the inside wall 43 of the tubular member 42 would be in waterproof engagement with the upper wall 54 of the cap member 46. The flower could then be placed in a water-filled vase without risking the discoloration that would occur if the wire core 45 were exposed to water.

The present embodiments are illustrative and not restrictive. The scope of the invention is indicated by the claims rather than by the foregoing description. The invention may be embodied in other specific forms without departing from the spirit of the invention. Accordingly, all changes which come within the meaning and range of equivalents of the claims are intended to be embraced therein.

We claim:

1. An artificial flower for use in water comprising a corrosion resistant metal stem, said metal stem having a thin coating of resilient material simulating the look of a flower stem.

2. The artificial flower of claim 1 wherein said corrosion resistant metal is stainless steel.

3. The artificial flower of claim 1 wherein said corrosion resistant metal is bronze.

4. The artificial flower of claim 1 wherein said thin coating of resilient material is plastic.

5. The artificial flower of claim 1 wherein said thin coating of resilient material is rubber.

6. A method of presenting artificial flowers which comprises:

placing an artificial flower stem into a container holding a fluid to thereby give the appearance of a real flower to an observer, said stem comprising a corrosion resistant metal, said metal having a thin coating of material directly contiguous with the metal thereby simulating the look of a natural flower stem.

* * * * *